United States Patent [19]

Flores

[11] 4,000,901

[45] Jan. 4, 1977

[54] RING PUZZLE

[75] Inventor: Raul Flores, Chicago, Ill.

[73] Assignee: Lawrence Peska Associates, Inc., New York, N.Y. ; a part interest

[22] Filed: July 8, 1975

[21] Appl. No.: 593,933

[52] U.S. Cl. ..... 273/158

[51] Int. Cl.[2] ..... A63F 9/08

[58] Field of Search ..... 273/158

[56] References Cited

UNITED STATES PATENTS

| | | | |
|---|---|---|---|
| 3,698,719 | 10/1972 | Winslow | 273/158 |
| 3,706,458 | 12/1972 | Jones | 273/158 |
| D226,017 | 1/1973 | Graham et al. | 273/158 UX |

*Primary Examiner*—Anton O. Oechsle

[57] ABSTRACT

A ring puzzle capable of being easily disassembled includes a base having a plurality of longitudinally aligned apertures therethrough. A plurality of joining members are pivotally mounted through the apertures of the base. A ring member is detachably joined to each joining member and looped over the next adjacent joining member. A closed end loop member is slidably contained through the ring members and straddling each joining member.

3 Claims, 2 Drawing Figures

RING PUZZLE

BACKGROUND OF THE INVENTION

A plurality of ring puzzles are illustrated in U.S. Pat. Nos. 1,091,709; 2,998,253; and 3,198,524, wherein ring shaped members are disengaged from another object. A major drawback of these inventions is that the only way for the puzzle to be disassembled is to solve the puzzle. My present invention allows the puzzle to be assembled or disassembled without having to solve the puzzle.

SUMMARY OF THE INVENTION

My present invention relates to a unique and novel construction for a ring puzzle.

An object of my present invention is to provide a ring puzzle capable of being easily disassembled into its component parts.

A further object of my present invention is to provide a means of increasing the difficulty of the puzzle game by providing movement of the ring members within the joining members.

A further object of my present invention is to provide a means for changing the number of ring members.

Briefly, my present invention comprises a base having a plurality of longitudinally aligned apertures therethrough. A plurality of joining members are pivotally mounted through the apertures of the base. A ring member is detachably joined to each joining member and looped over the next adjacent joining member. A closed end loop member is slidably contained through the ring members and straddling each joining member.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
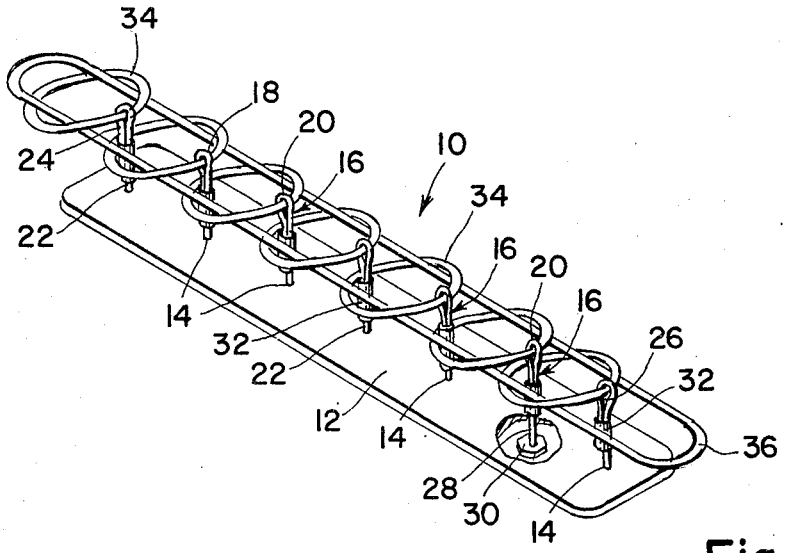
FIG. 1 illustrates a perspective view of the invention.
Figure 2:
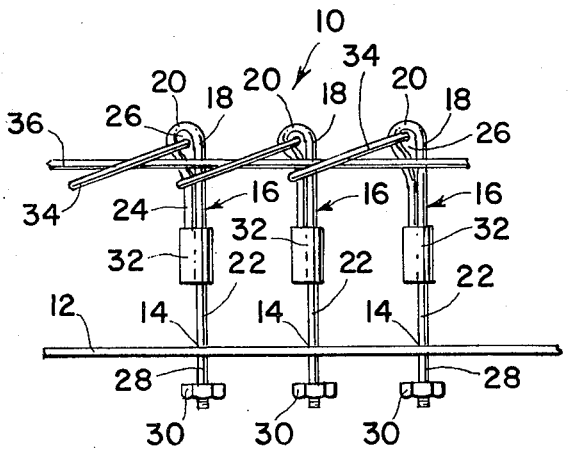
FIG. 2 illustrates a side view of the invention

Turning now descriptively to the drawings, in which similar reference characters denote similar elements throughout the several views, FIGS. 1–2 show a ring puzzle 10 capable of being easily disassembled into its component parts or reassembled. An elongated flat base 12 has a plurality of longitudinally aligned apertures 14 therethrough. A plurality of upwardly extending joining members 16 are pivotally mounted through each aperture 14. Each joining member 16 is formed from an inverted U-shaped member 18 having a base 20, a longer leg 22 and a shorter leg 24, wherein leg 24 is bent inward towards leg 22 to form an opening 26 between the junctures of legs 22, 24 and base 20. The free end 28 of the longer leg 22 is externally threaded, wherein leg 22 extends through the aperture 14. A nut member 30 threadably engages end 28 thereby preventing leg 22 from being pulled out from aperture 22. A collar member 32 is slidably contained on leg 22, wherein collar 32 slides over legs 22, 24 so as to hold legs 22, 24 closed together. A closed ring member 34 is looped through each opening 26. Each ring member 34 is looped around the next adjacent joining member 16.

A closed end elongated loop member 36 is slidably contained through ring members 24, wherein loop member 36 straddles the joining members 16. Through a series of manual manipulations of moving loop member left and right, dropping and raising the ring members 34 through loop member 36; and passing the loop member 36 through the ring member 34, the loop member 36 can be disengaged from the ring members 34. During the operation of attempting the disengage loop member 36 from ring members 34, the ring members 34 move up and down within opening 26 and leg 22 slides within aperture 14 thereby increasing the difficulty of the puzzle 10.

In order to disassemble the puzzle 10 into its component parts, the collar 32 is disengaged from leg 24. Each ring member 34 is disengaged from each joining member 16 by sliding the ring member 34 outwardly from opening 26 between legs 22, 24. The nut member 30 is disengaged from the free end 28 of leg 22 thereby allowing each joining member 16 to be disengaged from base 12. Once all the ring members 34 have been disengaged from the joining members 16, the loop member 36 can be disengaged from the ring members 34.

The number of joining members 16 and ring members 34 can be readily changed to vary the degree of difficulty of the puzzle 10, but as illustrated they are seven in number.

Since obvious changes may be made in the specific embodiment of the invention described herein, such modifications being within the spirit and scope of the invention claimed, it is indicated that all matter contained herein is intended as an illustrative and not as limiting in scope.

Having thus described the invention, what I claim as new and desire to secure by Letters Patent of the United States is:

1. A ring puzzle capable of being easily disassembled, which comprises:

a. a flat elongated base having a plurality of longitudinally aligned apertures therethrough;

b. a plurality of inverted U-shaped members, each U-shaped member having a base, a longer leg, and a shorter leg bent inwardly towards said longer leg thereby forming an opening between said legs and said bases, a free end of each said longer leg pivotally mounted through each said aperture;

c. a closed ring member looped through each said opening of each said U-shaped member, each said ring member looped over an adjacent said U-shaped member;

d. a closed end loop member slidably extending through said ring members and straddling said U-shaped members;

e. means for holding closed said shorter leg and said longer leg, said means including a collar slidably mounted on said longer leg and sliding over said shorter leg; and f. means for holding said longer leg in said aperture thereby preventing disengagement of said longer leg from said base.

2. A puzzle according to claim 1, wherein said means for holding said longer leg in said aperture further includes a nut member threadably engaging a threaded free end of said longer leg.

3. A puzzle according to claim 1, wherein said U-shaped members and said ring members are each seven in number.

* * * * *